US005268005A

United States Patent [19]

Suhonen

[11] Patent Number: 5,268,005

[45] Date of Patent: Dec. 7, 1993

[54] METHOD FOR RING-DYEING NYLON FILAMENTS WITH INDIGOTINE DYE FOR TOOTH-BRUSHES

[75] Inventor: Christopher H. Suhonen, San Jose, Calif.

[73] Assignee: Gillette Canada Inc., Canada

[21] Appl. No.: 995,336

[22] Filed: Dec. 22, 1992

Related U.S. Application Data

[63] Continuation of Ser. No. 716,196, Jun. 17, 1991, abandoned.

[51] Int. Cl.[5] ..... C09B 7/00; D06P 5/00; A46B 9/04

[52] U.S. Cl. ..... 8/504; 8/502; 8/650; 8/653; 8/924; 15/167.1; 15/207.2; 428/378

[58] Field of Search ..... 8/502, 504, 516, 653

[56] References Cited

U.S. PATENT DOCUMENTS 2,558,992 7/1951 Stott ..... 8/516
3,258,805 7/1966 Rossnan ..... 15/110
4,802,255 2/1989 Breuer et al. ..... 8/516

FOREIGN PATENT DOCUMENTS 81109750.0 5/1983 European Pat. Off. .
2137080 9/1984 United Kingdom .

*Primary Examiner*—A. Lionel Clingman
*Attorney, Agent, or Firm*—Fish & Richardson

[57] ABSTRACT

A method for dyeing nylon filaments for use in wear-indicating toothbrushes includes immersing a batch of a first nylon filament for between 10 minutes and 80 minutes in an aqueous solution containing between 0.01% and 0.19% weight to volume of Indigotine dye, said solution having a pH between 1 and 7 and having a temperature between 50° C. and 90° C., the dye penetrating into the filament to color an outer cross-sectional region and not penetrating into an inner cross-sectional region of the filament; removing the batch of the first nylon filament from the solution, and repeating the steps for a batch of a second nylon filament, reusing the same solution.

8 Claims, No Drawings

METHOD FOR RING-DYEING NYLON FILAMENTS WITH INDIGOTINE DYE FOR TOOTH-BRUSHES

This is a continuation of application Ser. No. 07/716,196, filed Jun. 17, 1991, now abandoned.

BACKGROUND OF THE INVENTION

The invention relates to filaments for toothbrushes.

Breuer et al., U.S. Pat. No. 4,802,255, which is hereby incorporated by reference, describes nylon monofilaments that include at least two colored regions, one of which is provided by a dye. The monofilaments are included in the bristles of toothbrushes and, as the toothbrush is used by the owner, the color intensity of the dyed region changes in response to wear, providing an indication of when the toothbrush should be replaced. Breuer et al. lists six food dyes or colorants that can be used to dye the monofilaments, including Indigotine (FD&C Blue No. 2), and in col. 4 broadly describes the conditions that can be used for dyeing. Breuer et al. also provides a number of specific examples of dyeing procedures, including three (examples 4–6) in which Indigotine is used as the dye.

The specific dyeing procedures described by Breuer et al. were for laboratory samples. However, to produce a sufficient amount of dyed filaments for commercial toothbrushes, a procedure is needed that can be used for dyeing large amounts of filaments. The procedure should be cost-efficient and, of course, should produce nylon filaments that have a consistent level of dye penetration.

SUMMARY OF THE INVENTION

In general, the invention is a method for dyeing batches of nylon filaments for toothbrushes. As used herein, a batch is at least two pounds of nylon filament. The method includes immersing a batch of a first nylon filament for between 10 minutes and 80 minutes in an aqueous solution containing between 0.01% and 0.1% weight to volume of Indigotine dye. The solution should have a pH between 1 and 7, and should have a temperature between 50° C. and 90° C. While the nylon filament is immersed, the dye penetrates into an outer cross-sectional region but not into an inner cross-sectional region. The batch of the first nylon filament is removed from the solution, and can be used for bristles in a wear-indicating toothbrush. The same procedure is repeated for a batch of a second nylon filament, reusing the same solution. Preferably, the same solution is then used for dyeing additional batches.

In the preferred method, the aqueous solution contains between 0.01% and 0.05% weight to volume of Indigotine dye; the solution has a pH of between 2.5 and 4.5; and the temperature of the solution is between 70° C. and 85° C. Preferably, the dyeing step is performed at atmospheric pressure and takes less than 60 minutes, and the nylon filaments have a diameter of between 0.005 inches and 0.014 inches.

The method can be used to produce commercial quantities of nylon filaments for use in wear-indicating toothbrushes in a cost-effective manner. For example, the procedure can be used on 10–40 lb. batches of nylon filaments, and even on batches weighing 100 lbs or more. Importantly, the same solution can be reused at least once, and even up to five or six times, and still produce filaments in which the Indigotine dye has penetrated an even, consistent cross-sectional area. The method is easy to carry out, safe, and provides a stable dye solution.

Other advantages of the invention will be apparent from the description of the preferred embodiment thereof, and from the claims.

DESCRIPTION OF THE PREFERRED EMBODIMENT

Dyed wear-indicating nylon monofilaments, toothbrushes including such monofilaments, and the way the toothbrushes are made are described in detail in Breuer et al.

The dyeing solution used in the method of the invention contains between 0.01% and 0.1% weight to volume Indigotine. If too much Indigotine is used, too much dye penetrates too far into the filament. If too little dye is used, too little dye may penetrate, and the solution may not be reusable because the initial batch of filament may absorb the limited quantity of dye present.

The temperature of the solution should be between 50° C. and 90° C. Too high a temperature results in water quickly evaporating off, resulting in the dye becoming more concentrated, and the dye being taken up too fast, making the degree of penetration more difficult to control. Too low a temperature results in too slow a dye uptake.

The dyeing process preferably is done at atmospheric pressure, to avoid the necessity of using large pressurized equipment in a plant.

Indigotine is an acid stable dye, and the solution should be acidic.

The volume of dyeing solution should be large enough so that the first batch of filament does not absorb such a high percentage of the dye in the solution that the solution cannot be reused to dye a second batch.

The nylon filaments, most preferably monofilaments, should be of the diameter commonly used in toothbrushes, most preferably 0.008 or 0.009 inch.

The nylon filament should be immersed in solution long enough to get adequate dye penetration of the outer cross-sectional diameter of the filament to provide good wear-indicating characteristics. Preferably, the immersion time should be as limited as possible, and should be less than 1 hour.

A detailed description of the most preferred method is provided below, beginning with a description of the equipment and solutions used, followed by the procedure.

The dyeing step is performed in a 633 gallon Whiting stainless steel tank having side dimensions of 30"×40"×130".

The dyeing solution used in the tank includes 633 gallons of distilled water; 7.7 liters of glacial acidic acid; and 555 g of 100% pure Indigotine. The temperature of the solution is maintained at 75° C.±1.5° C.

Two 633 gallon rinse tanks also are used. The first tank is filled with tap water. The second tank is filled with tap water mixed with 1.5 liters of Dow Corning #24 silicone The monofilament used is an eight foot long, 0.008 inch diameter Wytex 6.12 S nylon hank (bundle) weighing approximately 10 pounds. The hank should be siliconed, annealed, wet, and combed prior to dyeing, according to standard procedures. The hank should not be dried prior to use.

Dyeing Procedure

1) Completely submerse four hanks in the dye solution.
2) Set timer for 45 minutes.
3) Lift and resubmerse hanks every 1.5 minutes to permit circulation of dye between filaments.
4) After 45 minutes, remove hanks and transfer to the first rinse tank. Rinse by dipping 4 to 5 times.
5) Transfer the to the second rinse tank. Continue rinsing by dipping another 4 to 5 times. This rinse will restore the finish lost during the dyeing process.
6) Recomb hanks and continue with the normal drying and wrapping process.
7) Repeat the procedure 4 times for additional batches of hanks, using the same solutions. The dye solution and first rinse are changed after 5 hanks have been dyed; the second rinse solution is replaced daily.

Optionally, the above procedure can be modified by immersing set of hanks for 30 minutes in a dyeing solution heated to 80° C.±1.5° C. In addition, the procedure can be used to dye 10 hanks at a time, as opposed to four hanks.

Other embodiments are within the claims.

I claim:

1. A method of dyeing and affixing nylon filaments to toothbrushes, comprising:

(a) immersing a first batch of a nylon filament for between 10 minutes and 80 minutes in an aqueous solution comprising between 0.01% and 0.05% weight to volume of Indigotine dye, said solution having a pH between 2.5 and 4.5, and having a temperature between 70° C. and 85° C., said Indigotine dye consistently penetrating into said nylon filament to color an even outer cross-sectional region of said nylon filament, and not penetrating into an inner cross-sectional region of said nylon filament;

(b) removing the first batch of said nylon filament from said solution to provide a first dyed nylon filament having said outer cross-sectional region colored with said Indigotine dye and said inner cross-sectional region not colored with said Indigotine dye;

(c) affixing said first dyed nylon filament to the head of a first toothbrush;

(d) repeating steps (a), (b), and (c) for a second batch of a nylon filament and a second toothbrush, reusing the same said solution, to provide first and second toothbrushes each having the same amount of said Indigotine dye consistently penetrating into said nylon filament to color evenly the same outer cross-sectional region of said nylon filament in each toothbrush.

2. The method of claim 1 comprising the additional step of repeating steps (a), (b), and (c) for a third batch of a nylon filament and a third toothbrush, reusing the same said solution, to provide first, second and third toothbrushes each having the same amount of said Indigotine dye consistently penetrating into said nylon filament to color evenly the same outer cross-sectional region of said nylon filament in each toothbrush.

3. The method of claim 2 comprising the additional step of repeating steps (a), (b), and (c) for a fourth batch of a nylon filament and a fourth toothbrush, reusing the same said solution, to provide first, second, third, and fourth toothbrushes each having the same amount of said Indigotine dye consistently penetrating into said nylon filament to color evenly the same outer cross-sectional region of said nylon filament in each toothbrush.

4. The method of claim 1 wherein step (a) is performed at atmospheric pressure.

5. The method of claim 1 wherein said first nylon filament and said second nylon filament have an average diameter of between 0.005 inches and 0.014 inches.

6. The method of claim 1 wherein said first nylon filament and said second nylon filament are monofilaments.

7. The method of claim 1 wherein said first nylon filament is immersed in said aqueous solution for less than 60 minutes.

8. The method of claim 1 wherein said batch of said first nylon filament weighs at least 10 lbs.

* * * * *

UNITED STATES PATENT AND TRADEMARK OFFICE

CERTIFICATE OF CORRECTION

PATENT NO. : 5,268,005

DATED : December 7, 1993

INVENTOR(S) : Christopher H. Suhonen

It is certified that error appears in the above-identified patent and that said Letters Patent is hereby corrected as shown below:

Column 3, line 10, after "the" (first occurrence) insert -- hanks --.

Signed and Sealed this

Twenty-fourth Day of May, 1994

Bruce Lehman

BRUCE LEHMAN

*Commissioner of Patents and Trademarks*

*Attest:*

*Attesting Officer*